US010076005B2

(12) United States Patent
Childers

(10) Patent No.: US 10,076,005 B2
(45) Date of Patent: Sep. 11, 2018

(54) LIGHTING DEVICE WITH FACETED REFLECTOR

(71) Applicant: Phoseon Technology, Inc., Hillsboro, OR (US)

(72) Inventor: Doug Childers, Portland, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 308 days.

(21) Appl. No.: 14/882,031

(22) Filed: Oct. 13, 2015

(65) Prior Publication Data

US 2016/0109097 A1 Apr. 21, 2016

Related U.S. Application Data

(60) Provisional application No. 62/066,228, filed on Oct. 20, 2014.

(51) Int. Cl.

| | |
|---|---|
| ***F21K 9/60*** | (2016.01) |
| ***F21K 9/68*** | (2016.01) |
| ***H05B 33/08*** | (2006.01) |

(52) U.S. Cl.

CPC ..... *H05B 33/0812* (2013.01); *F21K 9/60* (2016.08); *F21K 9/68* (2016.08); *H05B 33/0806* (2013.01)

(58) Field of Classification Search

CPC ..... F21K 9/60; F21K 9/62; F21K 9/68; F21V 7/00; F21V 7/0025; F21V 7/0066; F21V 7/0075; F21V 7/0083; F21V 7/04; F21V 7/041; F21V 7/048; F21V 7/06; F21V 7/09; F21V 7/10; F21V 7/22; F21Y 2103/10; F21Y 2105/10; H05B 33/0806; H05B 33/0812

See application file for complete search history.

(56) References Cited

U.S. PATENT DOCUMENTS

| | | | | |
|---|---|---|---|---|
| 6,382,803 | B1 * | 5/2002 | Arumugasaamy | F21V 7/09 359/850 |
| 8,702,283 | B2 * | 4/2014 | Bradley, Jr. | F21V 7/0025 362/218 |
| 2009/0046454 | A1 * | 2/2009 | Bertram | G02B 27/0977 362/231 |
| 2009/0046468 | A1 * | 2/2009 | Wang | F21V 7/09 362/297 |
| 2009/0201677 | A1 * | 8/2009 | Hoelen | F21S 10/02 362/231 |
| 2014/0168972 | A1 * | 6/2014 | Ebner | F21V 5/007 362/235 |

* cited by examiner

*Primary Examiner* — Hargobind S Sawhney
(74) *Attorney, Agent, or Firm* — McCoy Russell LLP

(57) ABSTRACT

A lighting device may comprise a light emitting element and a reflector, the reflector comprising: a first opening surrounding the light emitting element and a second opening; reflector side walls forming the first and second openings, the reflector side walls divergently extending from the first opening away from the light emitting element to the second opening; and corner facets, wherein each corner facet is positioned over a corresponding reflector corner formed by an adjacent pair of reflector side walls at the first opening. In this way, a photosensitive work piece may be uniformly irradiated while mitigating under-curing and over-curing, and while reducing a coupling optics size and a distance between the light emitting elements and the work piece, thereby decreasing cure times and lowering manufacturing costs.

20 Claims, 10 Drawing Sheets

LIGHTING DEVICE WITH FACETED REFLECTOR

CROSS REFERENCE TO RELATED APPLICATIONS

The present application claims priority to U.S. Provisional Patent Application No. 62/066,228, entitled "TAPERED REFLECTOR WITH FACETED CORNERS FOR UNIFORM ILLUMINATION IN THE NEAR FIELD," filed on Oct. 20, 2014, the entire contents of which are hereby incorporated by reference for all purposes.

FIELD

The present description relates to lighting devices comprising faceted reflectors and methods for irradiating photosensitive materials.

BACKGROUND/SUMMARY

Solid-state light emitting elements such as light emitting diodes (LEDs) may be used to cure photosensitive media such as coatings, inks, adhesives, and the like. Effective curing of photosensitive materials involves uniformly irradiating light from LEDs on to the photosensitive material in order to mitigate under-curing or over-curing over a desired target area. The inventors herein have recognized potential issues with the above conventional lighting systems and methods. Namely, LEDs generally emit light in a hemispherical pattern, and may not irradiate the entire target area, which may be rectangular or otherwise non-hemispherically shaped, uniformly enough to mitigate under-curing or over-curing. Furthermore, coupling optics such as reflectors, which may be used in conjunction with LEDs to reflect the emitted light towards the target area, suffer from retro-reflection of light at the reflector corners, causing shadowing at the corners of the radiant output and can lead to under-curing portions of the target area.

One approach that may at least partially addresses the above issue includes a lighting device comprising a light emitting element and a reflector, the reflector comprising: a first opening surrounding the light emitting element and a second opening; reflector side walls forming the first and second openings; the reflector side walls divergently extending from the first opening away from the light emitting element to the second opening; and corner facets, wherein each corner facet is positioned over a corresponding reflector corner formed by an adjacent pair of reflector side walls at the first opening.

In another embodiment, a lighting method may comprise: emitting light from a light emitting element about a central axis on to a work piece; positioning a tapered reflector between the light emitting element and the work piece, wherein light emitted through the first opening and incident at tapered reflector side walls is collimated through the second opening of the tapered reflector toward the work piece about the central axis; and positioning corner facets at corresponding corners of the tapered reflector, wherein light incident at the corner facets is collimated towards the work piece about the central axis, wherein the tapered reflector side walls form the first opening proximal to the light emitting element and diverge away from the central axis towards the work piece to form the second opening, and the corresponding corners of the tapered reflector are formed by an intersection of an adjacent pair of reflector side walls and the first opening.

In another embodiment, a lighting device may comprise an array of light emitting elements, and a tapered frustum reflector having a shape aspect, the frustum reflector comprising: first and second openings having an opening shape corresponding to the shape aspect; reflector side walls joined to form the first and second openings, a number of reflector side walls corresponding to the shape aspect; and corner facets positioned at corners formed by intersection of adjacent reflector side walls and the first opening, a number of corner facets corresponding to the shape aspect.

In this manner, the technical effect of uniformly irradiating a target photosensitive work piece while mitigating under-curing and over-curing may be achieved, while reducing a size of the coupling optics and reducing a distance between the light emitting elements and the work piece, thereby decreasing cure times and lowering manufacturing costs.

DETAILED DESCRIPTION

Figure 1:
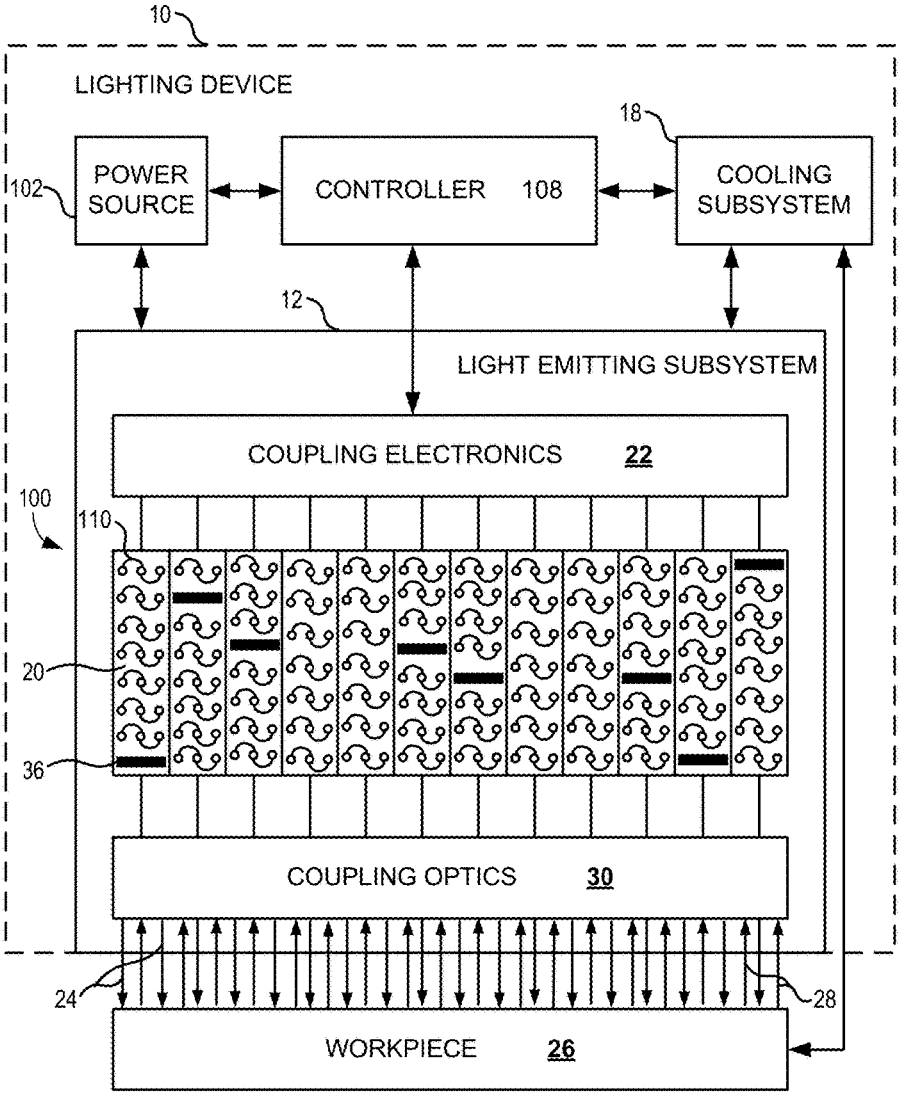
FIG. 1 shows a schematic depiction of a lighting device, including a light emitting subsystem.
Figure 2A:
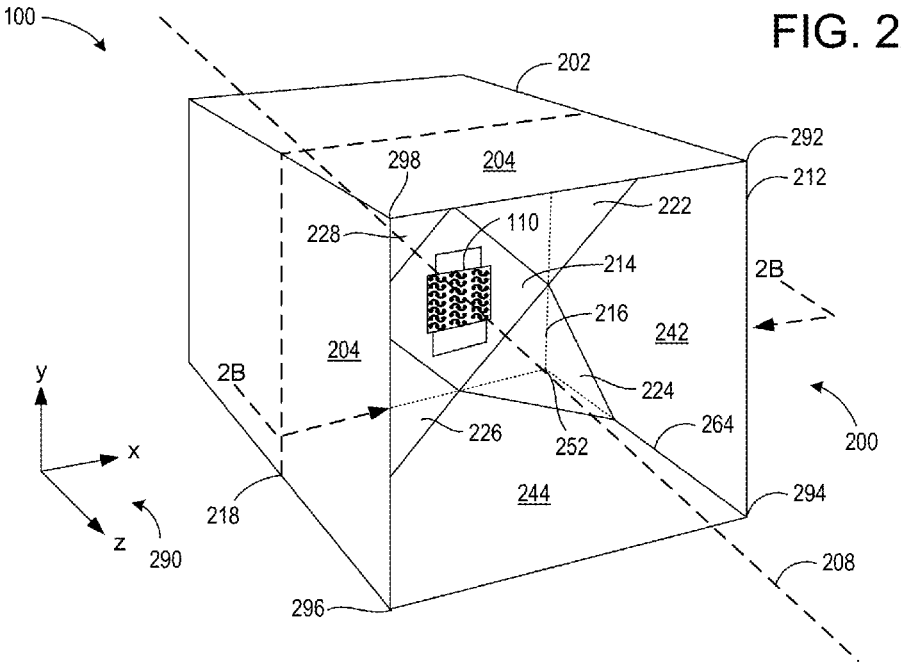
FIG. 2A shows a schematic of a perspective view of a lighting device including a reflector.
Figure 2B:
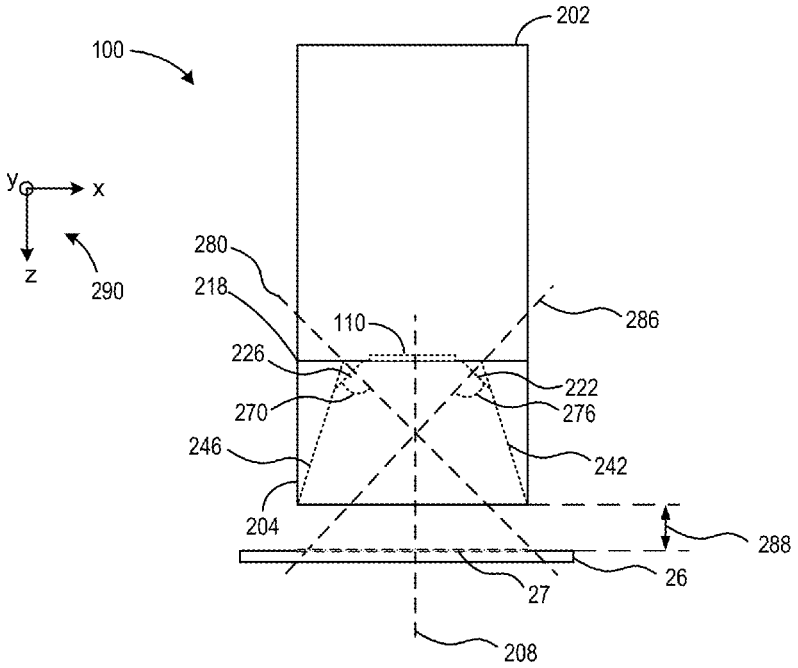
FIG. 2B shows a schematic of a cross-sectional view of the lighting device of FIG. 2A taken along the plane 2B-2B.
Figure 3:
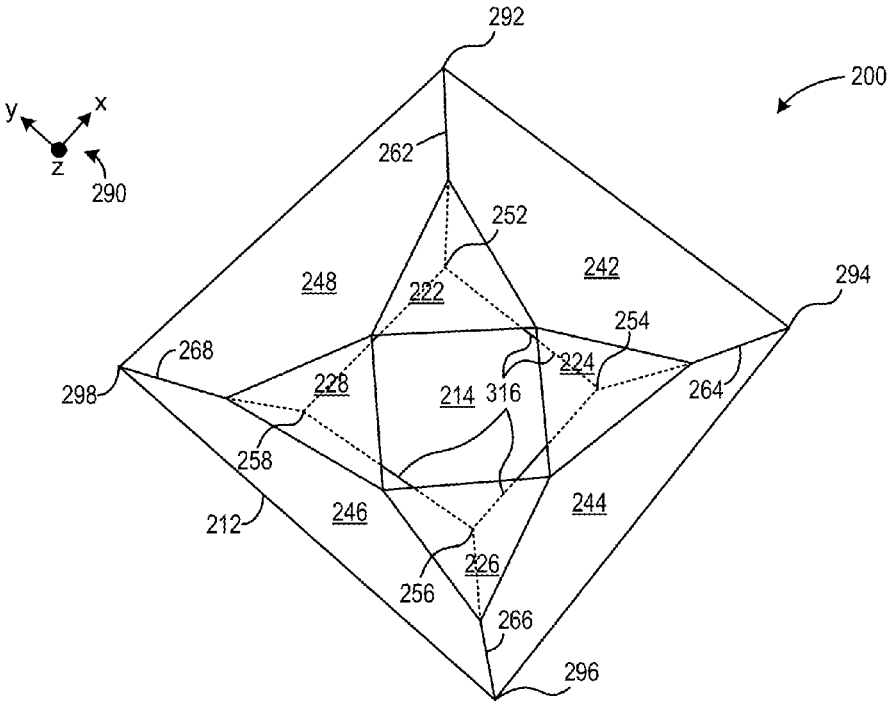
FIG. 3 shows a schematic of a top end view of the reflector of FIGS. 2A and 2B.
Figure 4:
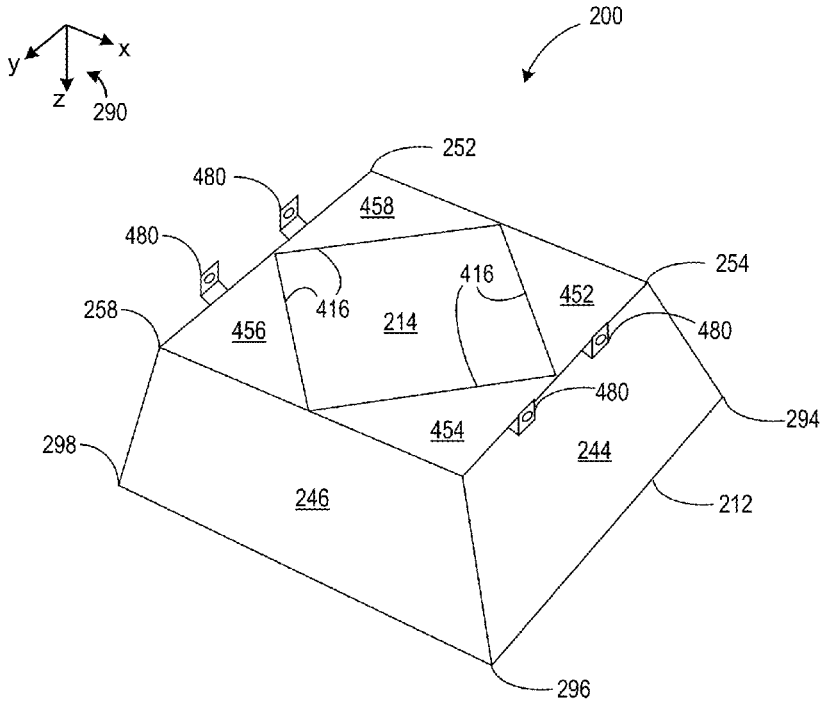
FIG. 4 shows a schematic of a bottom end view of the reflector of FIGS. 2A and 2B.
Figure 6A:
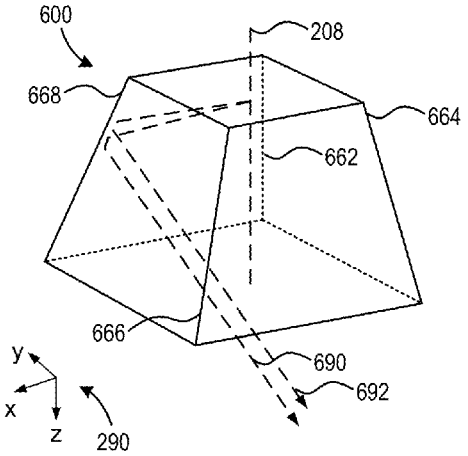
FIGS. 6A and 6B show schematics of a perspective view and end view of a tapered reflector having no corner facets.
Figure 6B:
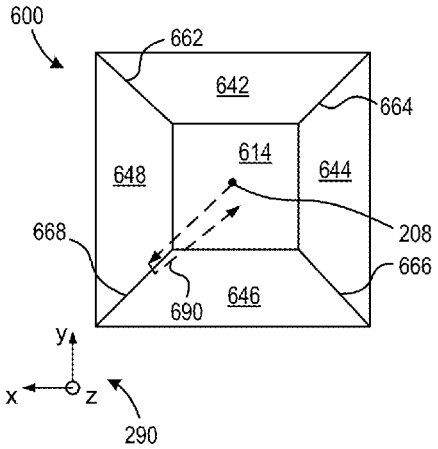
Figure 7:
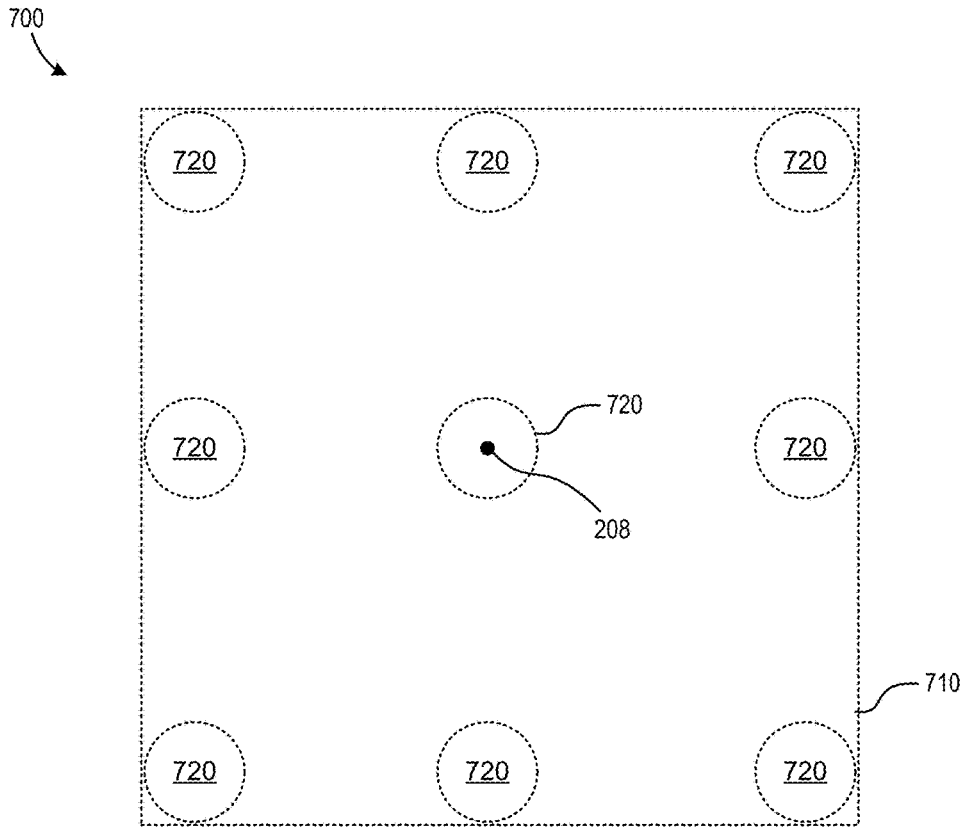
FIG. 7 illustrates a schematic for measuring the uniformity of radiant output.
Figure 8:
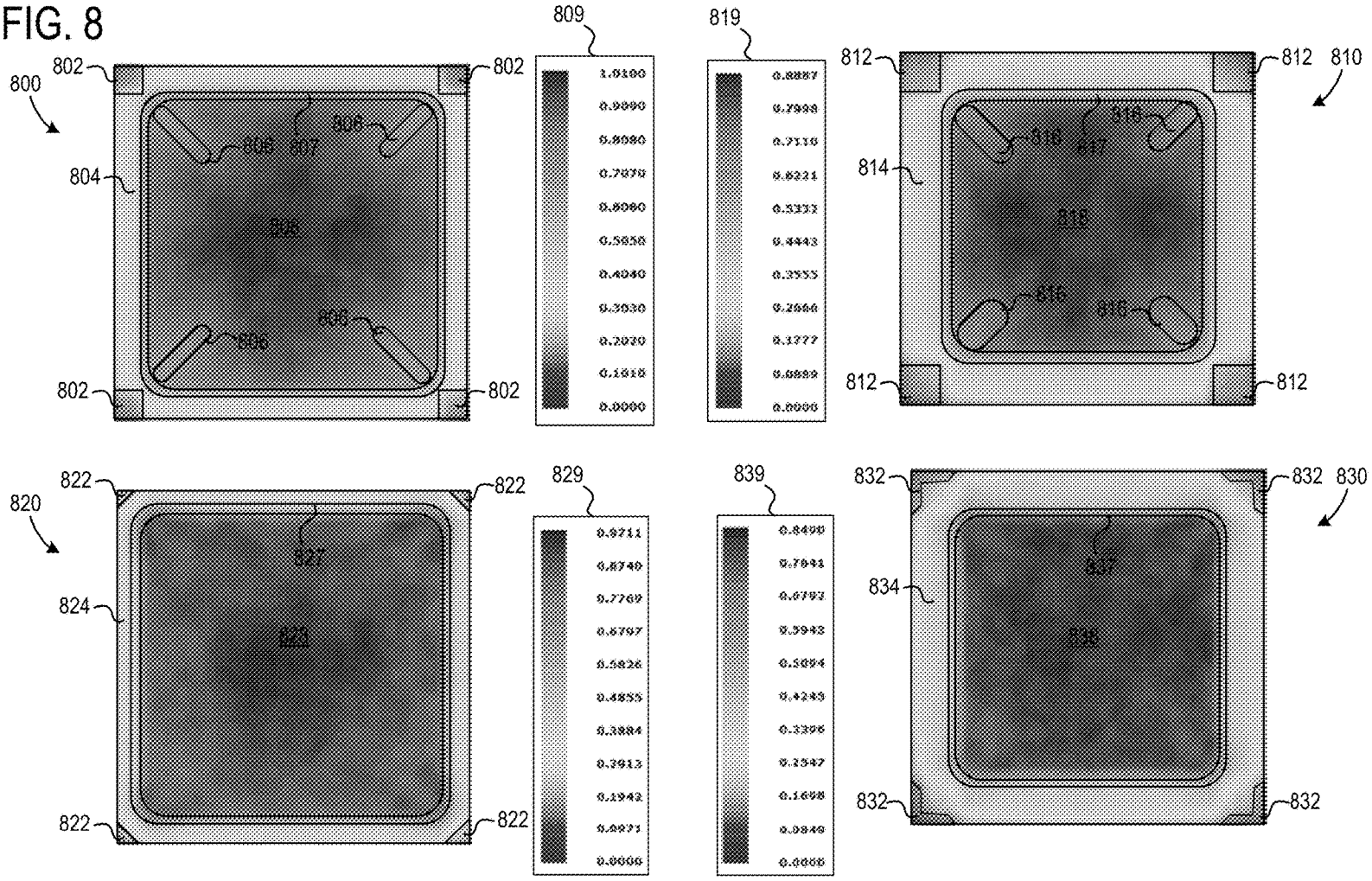
FIG. 8 shows a schematic illustrating radiant output distributions from various lighting devices.
Figure 9:
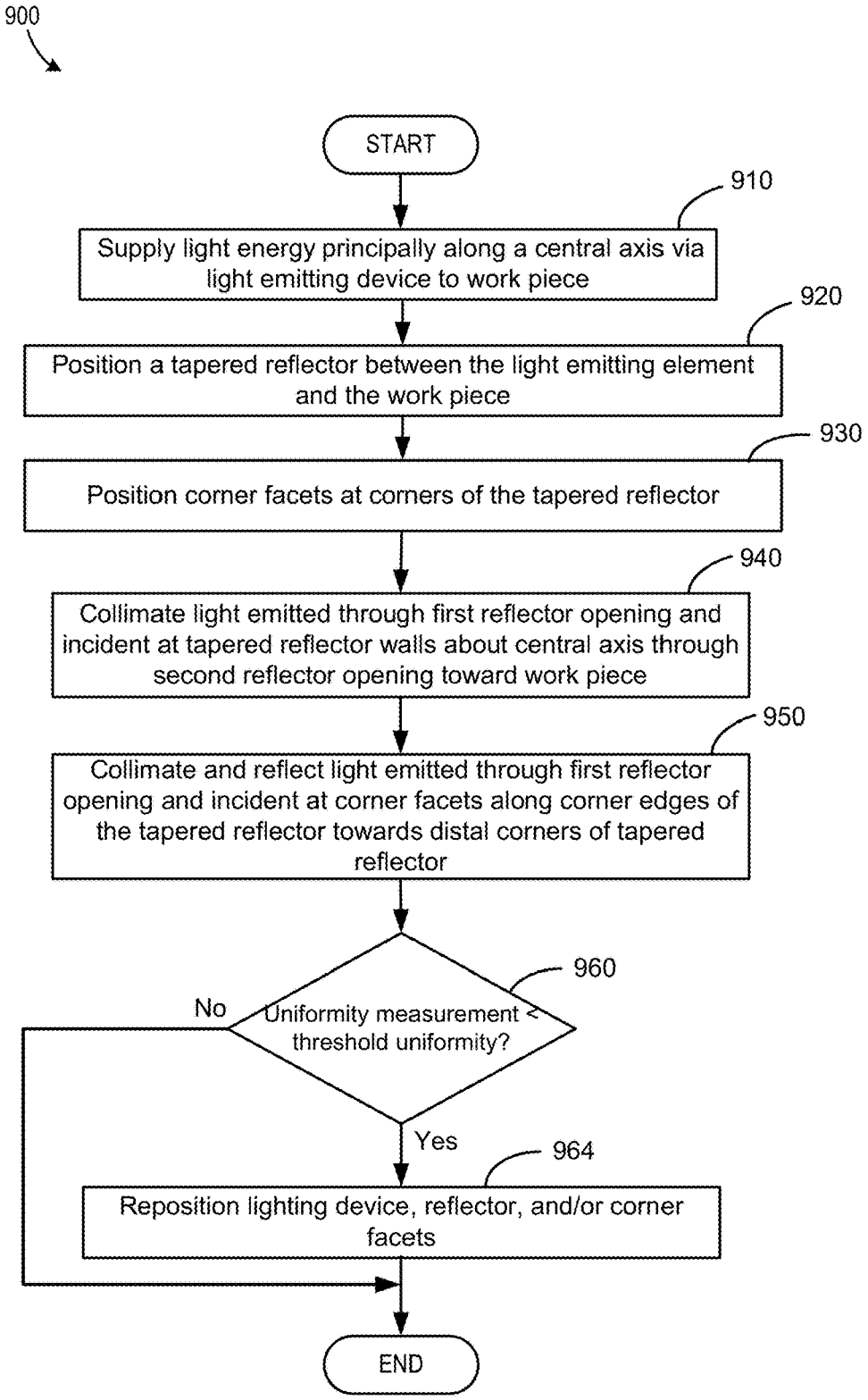
FIG. 9 shows a flow chart for an example lighting method employing the lighting device of FIGS. 2A and 2B.
Figure 10:
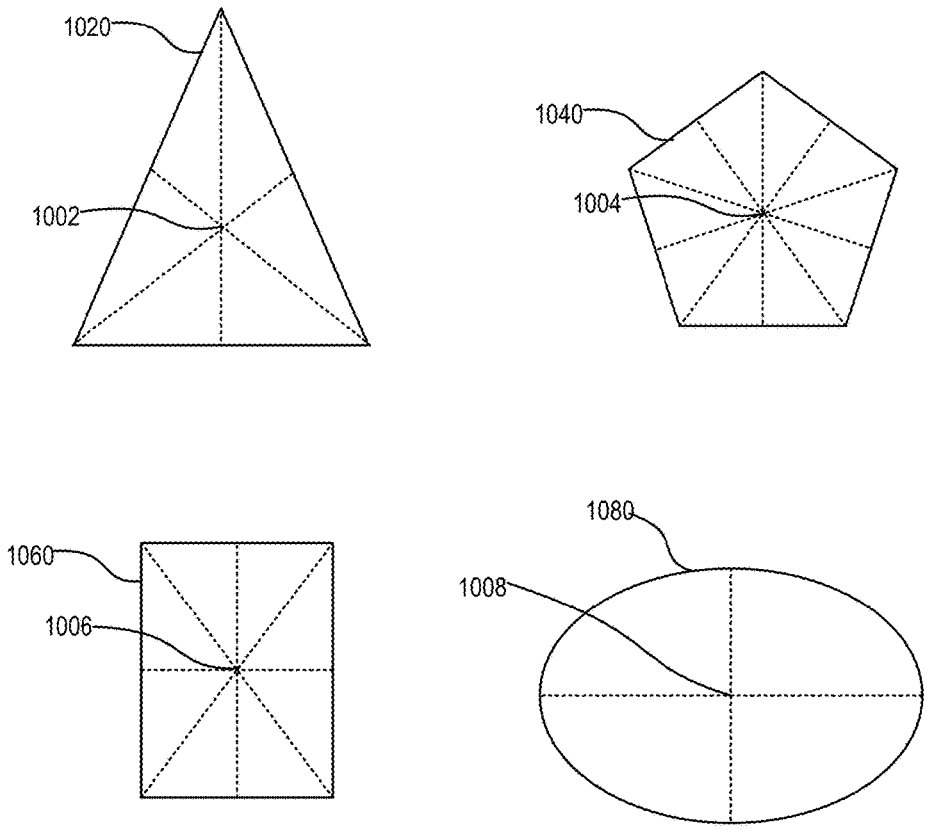
FIG. 10 shows examples of various shapes and their centroids

The present description is related to a lighting device comprising coupling optics including a tapered reflector having corner facets. FIG. 1 shows an example block diagram schematic of an example lighting device in which a tapered reflector having corner facets and a light emitting element are provided. FIGS. 2A and 2B illustrate a perspective and a cross-sectional view taken across plane 2B-2B of a lighting device, including the tapered reflector having the corner facets. The corner facets are illustrated from a top end view of the reflector of FIGS. 2A and 2B in FIG. 3, while a bottom end view of the tapered reflector is depicted in FIG. 4. Various examples of tapered reflectors and corner facets that may be employed with the lighting device of FIGS. 1, 2A, and 2B are shown in FIGS. 5A-5D. Schematics illustrating retro-reflection of incident radiant output at the reflector corners of a tapered reflector in FIGS. 6A and 6B are contrasted with schematics illustrating reflection of incident radiant output at the corners of a tapered reflector with corner facets in FIGS. 6C and 6D. FIG. 7 shows a schematic for measuring the uniformity of radiant output from a lighting device such as that of FIGS. 2A and 2B. Schematics illustrating the radiant output distributions at a target surface from various lighting devices are shown in FIG. 8. FIG. 9 shows a flow chart for an example lighting method for the lighting device of FIGS. 2A and 2B, for curing a photosensitive work piece. FIG. 10 shows examples of two-dimensional shapes and the location of their centroids.

Turning now to FIG. 1, the lighting system 100 may comprise a plurality of light emitting elements 110. Light emitting elements 110 may be LED elements, for example. Selected of the plurality of light emitting elements 110 are implemented to provide radiant output 24, and the radiant output 24 may be directed to a photosensitive curable work piece 26. Returned radiation 28 may be directed back to the lighting system 100 from the work piece 26 or to a location proximal to the light emitting elements 110 (e.g., via reflection of the radiant output 24 by reflector 200, shown in FIG. 2).

The radiant output 24 may be directed to the work piece 26 via coupling optics 30. The coupling optics 30, if used, may be variously implemented. As an example, the coupling optics may include one or more layers, materials or other structure interposed between the light emitting elements 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor elements providing radiant output 24 may be disposed in a respective micro-reflector, on a one-to-one basis. In another example, the coupling optics 30 may include a tapered reflector with a tapered end proximal to the light emitting elements 110. The reflector may also have a plurality of reflective facets arranged at each corner of the reflector at the tapered end, as shown in FIG. 2A and FIG. 3.

Each of the layers, materials or other coupling optics structure may have a selected index of refraction. By properly selecting each index of refraction, reflection at interfaces between layers, materials and other structure in the path of the radiant output 24 (and/or returned radiation 28) may be selectively controlled. As an example, by controlling differences in such indexes of refraction at a selected interface disposed between the semiconductor elements to the work piece 26 via the coupling optics, such as a tapered reflector, reflection at that interface may be altered, reduced, eliminated, or minimized, so as to enhance the transmission of radiant output 24 at that interface for maximal delivery to target area(s) in the work piece 26.

The coupling optics 30 may be employed for various purposes. Example purposes include, among others, to protect the light emitting elements 110, to retain cooling fluid associated with the cooling subsystem 18, to collect, condense and/or collimate the radiant output 24, to collect, direct or reject returned radiation 28, or for other purposes, alone or in combination. As a further example, the lighting device 10 may employ coupling optics 30 so as to enhance the effective quality or quantity of the radiant output 24, particularly as delivered to the target area(s) in the work piece 26.

Selected of the plurality of light emitting elements 110 may be coupled to the controller 108 via coupling electronics 22, so as to provide data to the controller 108. In one example, the controller 108 may also be implemented to control such data-providing semiconductor elements, e.g., via the coupling electronics 22. The controller 108 preferably is also connected to, and is implemented to control, each of the power source 102 and the cooling subsystem 18. Moreover, the controller 108 may receive data from power source 102 and cooling subsystem 18.

The data received by the controller 108 from one or more of the power source 102, the cooling subsystem 18, the lighting system 100 may be of various types. As an example, the data may be representative of one or more characteristics associated with coupled light emitting elements 110, respectively. As another example, the data may be representative of one or more characteristics associated with the respective components light emitting subsystem 12, power source 102, and/or cooling subsystem 18 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the power source 102, cooling subsystem 18, and lighting system 100 (including one or more such coupled semiconductor elements). As an example, responsive to data from the light emitting subsystem indicating that the light energy is insufficient at one or more points associated with the work piece, the controller 108 may be implemented to either (a) increase the power source's supply of current and/or voltage to one or more of the light emitting elements 110, (b) increase cooling of the lighting subsystem via the cooling subsystem 18 (i.e., certain light emitting elements, if cooled, provide greater radiant output), (c) increase the time during which the power is supplied to such elements, or (d) a combination of the above.

Individual light emitting elements 110 (e.g., LED elements) of the lighting system 100 may be controlled independently by controller 108. For example, controller 108 may control a first group of one or more individual LED elements to emit light of a first intensity, wavelength, and the like, while controlling a second group of one or more individual LED elements to emit light of a different intensity, wavelength, and the like. The first group of one or more individual LED elements may be within the same array of light emitting elements 110, or may be from more than one array of light emitting elements 110. Arrays of light emitting elements 110 may also be controlled independently by controller 108 from other arrays of light emitting elements 110 in lighting system 100 by controller 108. For example, the semiconductor elements of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate lighting device 10 to implement a first control strategy, whereas under a second set of conditions (e.g. for a specific work piece, photoreaction, and/or set of operating conditions) controller 108 may operate lighting device 10 to implement a second control strategy. As described above, the first control strategy may include operating a first group of one or more individual semiconductor elements (e.g., LED elements) to emit light of a first intensity, wavelength, and the like, while the second control strategy may include operating a second group of one or more individual LED elements to emit light of a second intensity, wavelength, and the like. The first group of LED elements may be the same group of LED elements as the second group, and may span one or more arrays of LED elements, or may be a different group of LED elements from the second group, and the different group of LED elements may include a subset of one or more LED elements from the second group.

The cooling subsystem 18 is implemented to manage the thermal behavior of the lighting system 100. For example, generally, the cooling subsystem 18 provides for cooling of such light emitting subsystem 12 and, more specifically, the light emitting elements 110. The cooling subsystem 18 may also be implemented to cool the work piece 26 and/or the space between the work piece 26 and the lighting device 10 (e.g., particularly, the lighting system 100). For example, cooling subsystem 18 may be an air or other fluid (e.g., water) cooling system.

The lighting device 10 may be used for various applications. Examples include, without limitation, curing applications ranging from ink printing to the fabrication of DVDs, adhesive curing, and lithography. Generally, the applications in which the lighting device 10 is employed have associated parameters. In order to properly accomplish the photoreaction associated with the given application, optical power may need to be delivered at or near the work piece at a specific location. In one example, a polygonal-shaped work piece, such as a rectangular work piece, may undergo said photoreaction using the lighting device 10. As a result, a lighting device 10 having an appropriate coupling optic 30, such as including reflector 200 of FIGS. 2A and 2B, may be employed.

In addition, the lighting device 10 supports monitoring of one or more application parameters. The lighting device 10 may provide for monitoring of light emitting elements 110, including their respective characteristics and specifications. Moreover, the lighting device 10 may also provide for monitoring of selected other components of the lighting device 10, including their respective characteristics and specifications.

Providing such monitoring may enable verification of the system's proper operation so that operation of lighting device 10 may be reliably evaluated. For example, the lighting device 10 may be operating in an undesirable way with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

In some applications, high radiant power may be delivered to the work piece 26. Accordingly, the light emitting subsystem 12 may be implemented using an array of light emitting light emitting elements 110. For example, the light emitting subsystem 12 may be implemented using a high-density, light emitting diode (LED) array. Although LED arrays may be used and are described in detail herein, it is understood that the light emitting elements 110, and array(s) of same, may be implemented using other light emitting technologies without departing from the principles of the description, examples of other light emitting technologies include, without limitation, organic LEDs, laser diodes, other semiconductor lasers. Furthermore, excitation radiation intensity may be adjusted by varying the intensity of the LED array, varying the number of LEDs in the array, and by using coupling optics such as micro-lenses and/or reflectors, such as reflector 200 of FIG. 2, to, for example, collimate and/or focus the excitation radiation emitted from the LED array.

The plurality of light emitting elements 110 may be provided in the form of an array 20, or an array of arrays. The array 20 may be implemented so that one or more, or most of the light emitting elements 110 are configured to provide radiant output. At the same time, however, one or more of the array's light emitting elements 110 are implemented so as to provide for monitoring selected of the array's characteristics. The monitoring elements 36 may be selected from among the elements in the array 20 and, for example, may have the same structure as the other light emitting elements. For example, the difference between emitting and monitoring may be determined by the coupling electronics 22 associated with the particular semiconductor elements (e.g., in a basic form, an LED array may have monitoring LEDs where the coupling electronics provides a reverse current, and emitting LEDs where the coupling electronics provides a forward current).

Furthermore, based on coupling electronics, selected of the semiconductor light emitting elements 110 in the array 20 may be either/both multifunction elements and/or multimode elements, where (a) multifunction elements are capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode elements are capable of emission, detection and some other mode (e.g., off) and are switched among modes in accordance with the application parameters or other determinative factors.

Referring now to FIGS. 2A and 2B, they illustrate perspective and cross sectional views about plane 2B-2B respectively of an example lighting system 100 comprising a lighting device housing 202, reflector 200, and light emitting elements 110. FIGS. 2A and 2B are shown relative to x-y-z coordinate axes 290. In one example, light emitting elements 110 may include light emitting diodes (LEDs). Each LED may have an anode and a cathode, wherein the LEDs may be configured as a single array on a substrate, multiple arrays on a substrate, several arrays either single or multiple on several substrates connected together, etc. as described above with respect to FIG. 1. In one example, the array of light-emitting elements may consist of a Silicon Light Matrix™ (SLM) manufactured by Phoseon Technology, Inc. Light emitting elements 110 may be arranged to emit light principally about a central axis 208. Principally emitting radiant output 24 about the central axis 208 may comprise orienting the light emitting elements such that the radiant output 24 is emitted symmetrically about the central axis. Principally emitting radiant output 24 about the central axis may further comprise emitting radiant output with the highest intensity in the direction along the central axis. Furthermore, light emitting elements 110 may be positioned to be within 1 mm (along the z-axis) of the plane defined by the first opening 214 of reflector 200. In this way spacing and clearance can be provided for electrical wiring and connectors while decreasing an amount of radiant output 24 escaping from being directed through to the first opening 214.

Coupling optics 30 of lighting system 100 may comprise reflector 200, and may further comprise other coupling optics such as a micro-reflector array, condensing lens, and the like, as described above with respect to FIG. 1. Reflector 200 comprises a reflector housing 204 having walls that may be flush with and mounted to the lighting device housing 202. Moreover, reflector 200 may be disposed in a reflector housing 204, wherein the reflector housing 204 is coupled to the lighting system 100. Reflector housing 204 may provide structure and support for tapered reflector 200 to ensure stability and proper orientation to direct light from the light emitting elements 110.

Reflector 200 may further comprise reflector side walls 242, 244 (other side walls not visible in FIG. 2A), each reflector side wall being coupled with and having common edges with two adjacent reflector side walls. For example, reflector side wall 242 is adjacently coupled to reflector side wall 244 at edge 264. The reflector side walls may form a first opening 214 at a proximal end 218 (e.g., near z-axis) of the reflector 200 and surrounding the light emitting elements 110. Furthermore, the reflector side walls may divergently extend from the first opening 214 away (e.g., in the increasing z-axis direction) from the light emitting elements 110 to form the second opening 212. In this way, the reflector 200 may be described as a tapered reflector, the reflector side walls tapering from the second opening 212 distal from the light emitting elements 110 to the first opening 214 proximal to the light emitting elements 110. The first opening 214, second opening 212, and the reactor side walls may be arranged symmetrically about central axis 208.

Reflector corners are formed by the intersection of pairs of adjacent reflector side walls at the first opening 214. For example, reflector corner 252 is formed by the intersection of adjacent side walls 242 and 244, and first opening 214. Similarly, distal reflector corners 292, 294, 296 and 298 may be formed by the intersection of pairs of adjacent reflector side walls at the second opening 212. Reflector 200 may further comprise corner facets 222, 224, 226, and 228. Each of the corner facets 222, 224, 226, and 228 may be positioned at or over a corresponding reflector corner at a proximal end 218 (e.g., near z-axis) of reflector 200. For example, corner facet 224 may be positioned at corresponding corner 252. Corner facets may be positioned at or over a corresponding reflector corner so as to obstruct radiant output 24 from reaching each of the corresponding proximal reflector corners. Furthermore, each of the corner facets may be positioned to be non-coplanar with any of the reflector side walls and the first opening 214. In this way, the corner facets may aid in reducing retro-reflection of incident radiant output 24 at the reflector corners and may aid in increasing an amount of radiant output 24 being reflected along the reflector edges towards the distal corners.

In one example, corner facet 224 at corresponding corner 252 may be positioned such that an axis passing through the centroid of the facet that is normal (e.g., perpendicular) to the facet surface at the centroid is perpendicular to the central axis 208. The centroid or geometric center of a surface or object is the arithmetic mean position of all the points in the surface or object. The centroid may be defined as a fixed point of all isometries in its symmetry group. In particular, the geometric centroid of a corner facet may lie at the intersection of all its hyperplanes of symmetry and this principle may be used to locate the centroid for many types of shapes such as a regular polygon, regular polyhedron, cylinder, rectangle, rhombus, circle, sphere, ellipse, ellipsoid, superellipse, superellipsoid, and the like. FIG. 10 shows examples of centroids 1002, 1004, 1006, and 1008, for a triangle 1020, pentagon 1040, rectangle 1060, and ellipse 1080, respectively. The dashed lines in FIG. 10 represent hyperplanes of symmetry for each of the shapes shown in FIG. 10. For convex surfaces and shapes, the centroid may be located within the convex surface or shape and may not lie directly on the surface or shape.

As shown in FIG. 2B, normal centroidal axes 286 and 280 pass through the centroids and are perpendicular to the surfaces of corner facets 222 and 226 (at their centroids), respectively. In other words, angles 276 and 270 between normal centroidal axes 286 and 270 and corner facets 222 and 226, respectively, are approximately 90 degrees. For example, the angles 276 and 270 may be within 5 degrees of 90 degrees. The exact value of angles 276 and 270 may be dependent on the target distance 288 from the reflector 200 to the work piece 26, and may be adjusted to decrease an amount of retro-reflected light incident at the corner facets, while increasing an amount of corner illumination (e.g., incident light at the corner facets that is collimated and/or reflected along reflector edges to distal corners of reflector 200) at the target work piece surface. Corner facets 224 and 228 may also be positioned such that their normal centroidal axes pass through the corresponding corners at which they are positioned. In this way, radiant output 24 from light emitting elements 110 may be more uniformly directed and distributed about central axis 208 and across a photosensitive curable surface 27 of work piece 26. As further described below, the corner facets of reflector 200 may be positioned so as to reduce retro-reflection of incident radiant output thereat and to increase collimation and/or reflection of the incident radiant output thereat towards distal corners (e.g., 292, 294, 296, 298) formed by the reflector sidewalls and the second opening 212. In other words, incident radiant output at corner facets may be reflected along the edges (e.g., such as edge 264) between adjacent reflector sidewalls extending distally from the proximal corners corresponding to the corner facets to distal reflector corners. In this way corner facets may reduce shadowing (e.g., reduced irradiation of work piece 26) at the reflector corners of photosensitive curable surface 27. The photosensitive curable surface 27 of work piece 26 may be positioned a distance 288 away along the z-axis from the reflector 200. In one example, the distance 288 may include 10 to 20 mm, for close illumination applications. In another example, distance 288 may include a throw distance 288 greater than 10-20 mm. As described above, angles 276 and 270 may be adjusted to increase corner illumination at the target work piece surface. Angles 276 and 270 may further be adjusted to allow for adjustment of corner illumination at the target work piece surface at a distance 288. The corner facet shape and dimensions may also be adjusted to allow for adjustment of corner illumination at the target work piece surface at a distance 288 greater or less than 10 to 20 mm.

The corner facets 222, 224, 226, and 228 may be constructed of the same highly reflective materials as reflector side walls 242, 244, 246, and 248. As an example, the corner facets and reflector sidewalls may be constructed of an anodized aluminum with specular finish such as Lorin PreMirror®. Other materials include molded plastic having a highly reflective aluminum vapor deposition coating deposited thereon. In one example, a highly reflective material may comprise a material that is more than 75% reflective. In another example, a highly reflective material may comprise a material that is more than 85% reflective.

In the example of FIGS. 2A and 2B, the reflector 200 has a shape aspect of a rectangular frustum. A frustum is the portion of a solid (e.g., a pyramid, cone, and the like) that lies between two parallel planes cutting it. In the case of reflector 200, the rectangular frustum is composed of a regular pyramid having a rectangular polygon as its base. As such, reflector 200 comprises a first number of reflector side walls being four and the shape of the first opening 214 and the second opening 212 are rectangular, corresponding to the shape aspect of the reflector 200. Correspondingly, a number of facets may be four, corresponding to the rectangular shape aspect of the reflector 200. In other examples, the reflector 200 may have a shape aspect of another polygonal frustum such as a triangular, pentagonal, hexagonal, and the like, frustum; and the first number of reflector side walls may correspondingly be three, five, six, and the like, respectively; and the shape of the first opening 214 and the second opening 212 may correspondingly be triangular, pentagonal, hexagonal, and the like, respectively.

Turning now to FIG. 3, it illustrates an end view, oriented toward the negative z-direction, of reflector 200. As shown in FIG. 3, because the reflector side walls 242, 244, 246, and 248 extend divergently from the first opening 214 to the second opening 212, second opening 212 may be larger than the first opening 214. Furthermore, corner facets 222, 224, 226, and 228 are triangular in shape and are positioned at the reflector corners 252, 254, 256, and 258, respectively, such that normal centroidal axes pass through the reflector corners. In the example of FIG. 3, the corner facets may be arranged to partially overhang the first opening 214, as can be seen by the corner facets partially obscuring the edges 316 of first opening 214. Thus, arrangement of the corner facets may effectively reduce a size of the first opening 214 through which radiant output 24 is directed.

As shown in FIG. 3 for the case of reflector 200, a vertex of each corner facet may be positioned along an edge (e.g., one of 262, 264, 266, 268) between two adjacent reflector side walls (e.g., two of 242, 244, 246, 248) corresponding to the reflector corner at which the corner facet is positioned. Furthermore, other vertices of each corner facet may be positioned at the reflector side walls adjacent to the corresponding corner. For example, in the case of corner facet 224, a vertex is positioned at edge 264 between adjacent reflector side walls 242 and 244, while other vertices of corner facet 224 are positioned at adjacent reflector side walls 242 and 244, respectively. Positioning vertices of the corner facets may include mounting and/or attaching the vertices of the corner facets to the corresponding reflector side wall edges and adjacent reflector sidewalls. Attaching methods may include screwing, welding, adhering, clipping, and the like. In some examples, all of the vertices of the corner facets may be attached to the reflector side wall edges and reflector side walls. In other examples, some of the vertices of the corner facets may freely hang while other vertices of the corner facets may be fixed and attached. Corner facet vertices may also be attached to heat sinks, or other components located on the plane (having the same z-component) of the light emitting elements 110.

Turning now to FIG. 4, it illustrates a perspective end view of reflector 200, oriented toward the positive z-direction. Reflector 200 may comprise base plates 452, 454, 456, and 458 which are mounted at a proximal end (near z-axis) 218 and aid in maintaining rigidity of reflector 200 and also help in mounting or positioning reflector 200 on lighting device housing 202. As shown in FIG. 4, the base plates may partially obscure first opening 214 (formed by reflector side walls 242, 244, 246, and 248), and may be mounted in a planar fashion to be able to be mounted flush to the planar surface of the light emitting elements 110. The shape and dimensions of the base plates may correspond to the positioning of the corner facets, such that interior edges 416 of the base plates may coincide with the edges of the corner facets overhanging the first opening 214 (as shown in FIG. 3). In this way, the base plates may further aid in providing mechanical support to maintain rigidity and positioning of the corner facets. Reflector 200 may further comprise mounting means 480 for mounting the reflector to lighting device housing 202. As shown in FIG. 4, mounting means 480 may comprise clips, however, other mounting means such as welding, brackets, screws, rivets, and the like may be provided for attaching and mounting reflector 200 to lighting device housing 202. Rigidly mounting reflector to lighting device housing 202 may aid in directing radiant output 24 through the first opening 214 towards work piece 26.

Figure 5A:
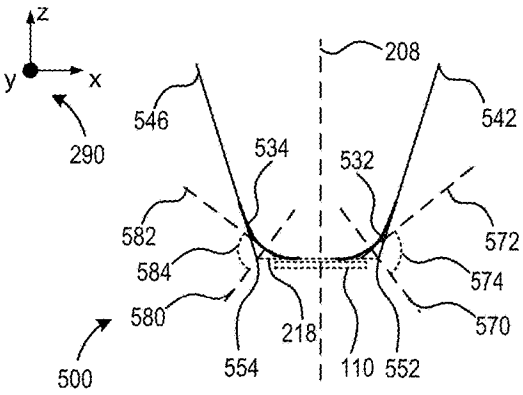
FIGS. 5A-5D show schematics of various example reflectors that may be used with the lighting device of FIGS. 2A and 2B.

Turning now to FIGS. 5A-5D, they illustrate various example configurations of reflectors that may be utilized with lighting device 10. FIG. 5A shows an example of a cross-sectional view of a tapered reflector 500 positioned over light emitting elements 110 arranged at a proximal end 218. Tapered reflector 500 includes non-planar corner facets 532 and 534 that are positioned to be non-coplanar with planar reflector side walls 542 and 546 and with the plane of the light emitting elements 110 (and the first opening 214). As examples, non-planar corner facets 532 and 534 may include parabolic, hyperbolic, cubic, and the like, non-planar surfaces. Furthermore corner facets 532 and 534 are positioned such that normal centroidal axes 570 and 580 of the corner facets 532 and 534, respectively, pass through proximal corners 552 and 554 of the tapered reflector 500. Normal centroidal axes 570 and 580 form approximately orthogonal angles 574 and 584, respectively, with tangents to the corner facets 532 and 534 at their centroids.

Figure 5B:
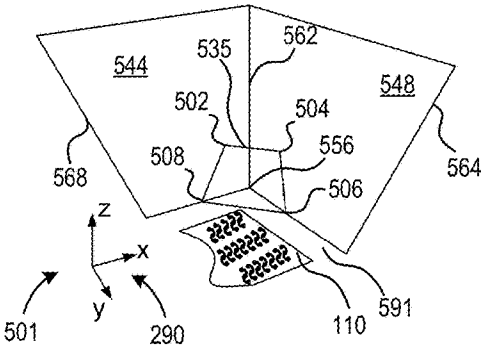

FIG. 5B shows a perspective cross-sectional view of a tapered reflector 501 including planar reflector side walls 544 and 548 adjacently coupled at edge 562. Tapered reflector 501 is positioned around light emitting elements 110 in a similar fashion to positioning of reflector 200. Furthermore reflector side walls 544 and 548 divergently extend from the reflector corners (e.g., including reflector corner 556) at the first opening proximal to the light emitting elements 110 to distal reflector corners at the second opening distal to the light emitting elements 110. Reflector 501 includes corner facet 535 positioned over reflector corner 556. As shown in FIG. 5B, corner facet 535 may comprise a quadrilateral polygon shape aspect such as a rhombus. As described above, corner facet 535 may be positioned such that a normal centroidal axis of corner facet 535 passes through reflector corner 556. In this way, corner facet 535 may reduce retro-reflection of incident radiant output 24 at reflector corner 556 and may increase a uniformity of light irradiating a work piece 26 positioned distally to reflector 501. As described above with reference to FIG. 3, one or more of corner facet vertices 502, 504, 506, and 508 may be coupled (e.g., welded, screwed, adhered, and the like) to the corresponding reflector side wall. Additionally or alternately, one or more of corner facet vertices 502, 504, 506, and 508 may be coupled to a reflector base plate (e.g., 452, 454, 456, 458), or another lighting device component positioned in the vicinity of the light emitting elements 110 such as a heat sink. For example, a corner facet coupling means (e.g., bracket, hook, and the like) may be positioned in a space 591 between light emitting elements 110 and the proximal edge of the corner facet.

Figure 5C:
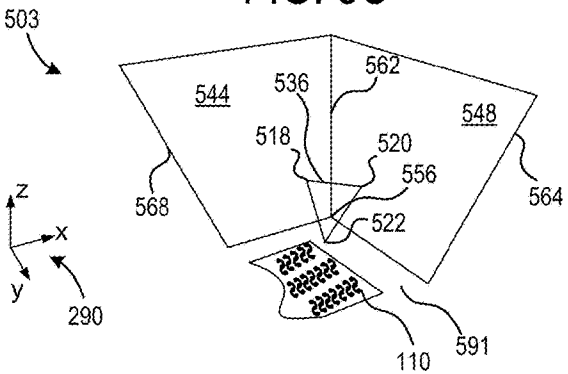

FIG. 5C shows a perspective cross-sectional view of a tapered reflector 503 including planar reflector side walls 544 and 548 adjacently coupled at edge 562. Tapered reflector 503 includes a triangular corner facet 536 positioned over reflector corner 556 such that a normal centroidal axis of corner facet 536 passes through reflector corner 556. Corner facet vertices 518 and 520 are positioned adjacent to reflector side walls 544 and 548, respectively. In one example, one or more of corner facet vertices 518 and 520 may be coupled to reflector side walls 544 and 548, respectively. In another example, corner facet vertex 522 may be coupled proximally to light emitting elements 110 in space 591 and vertices 518 and 522 may hang freely adjacent to reflector side walls 544 and 548.

Figure 5D:
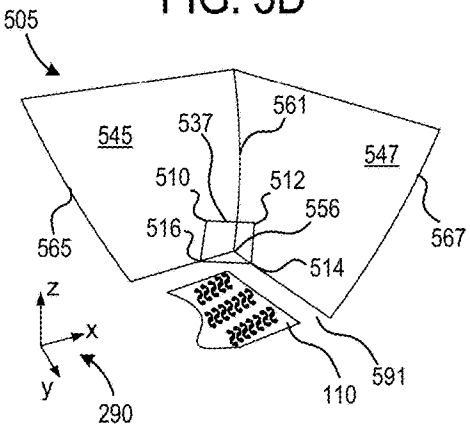

FIG. 5D shows a perspective cross-sectional view of a tapered reflector 505 including non-planar reflector side walls 545 and 547 adjacently coupled at non-linear edge 561. Non-planar reflector side walls 545 and 547 may be parabolic, hyberbolic, or other non-planar surfaces. Non-planar reflector side walls may be advantageous relative to planar reflector side walls because they may aid in collimating incident radiant output 24 more uniformly at a photosensitive curable surface 27 of work piece 26. As an example, non-planar reflector side walls may be manufactured by molding the reflector side wall surfaces followed by application or deposition of a reflective coating thereon. Tapered reflector 505 includes corner facet 537 positioned to obstruct radiant output 24 from light emitting elements 110 at reflector corner 556. As described above, a normal centroidal axis of corner facet 537 may pass through reflector corner 556. Corner facet 537 may comprise a planar rectangle shape. One or more of vertices 510, 512, 514, and 516 may be coupled to adjacent non-planar reflector side walls 545 and 547. Additionally, or alternately, one or more of vertices 514 and 516 may be coupled at the space 591 proximal (e.g., near z-axis) to the light emitting elements 110 and vertices 510 and 512 may be freely hanging adjacent to reflector side walls 545 and 547.

Turning now to FIGS. 6A and 6B, they illustrate schematics of a perspective view and an end view respectively of a tapered reflector 600 comprising: reflector side walls 642, 644, 646, and 648; first opening 614 at a proximal end; but having no corner facets. Light rays 690 and 692 may be emitted toward reflector corners at edges 662, 664, 666, and 668 as part of radiant output 24 from light emitting elements 110 positioned at a proximal end (near z-axis) of the reflector 600. As shown in FIGS. 6A and 6B, light rays 690 and 692 are retro-reflected at the reflector corners back towards central axis 208. In this way, reflector 600 having no corner facets increases retro-reflection of light from the reflector corners, and reduces an amount of light directed along the edges 662, 664, 666, and 668 towards distal reflector corners. Thus a uniformity in the distribution of light at a photosensitive curable surface of a work piece positioned at a distal side of reflector 600 may be reduced.

Figure 6C:
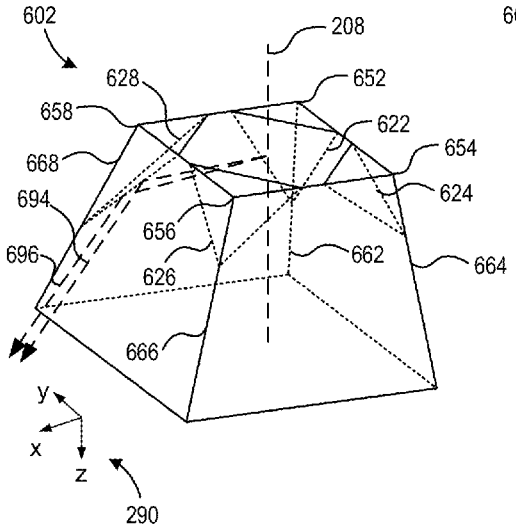
FIGS. 6C and 6D show schematics of a perspective view and end view of a tapered reflector having corner facets.
Figure 6D:
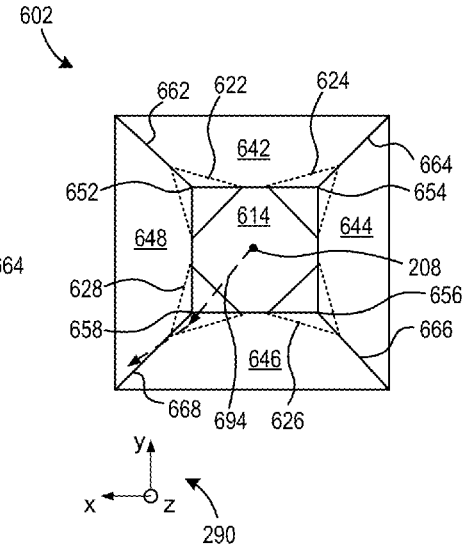

Turning now to FIGS. 6C and 6D, they illustrate schematics of a perspective view and an end view respectively of a tapered reflector 602 comprising: reflector side walls 642, 644, 646, and 648; first opening 614 at a proximal end; and corner facets 622, 624, 626, and 628 positioned at corresponding corners 652, 654, 656, and 658, respectively. As described above, the corner facets may be positioned so as to obstruct the reflector corners from incident radiant output 24 emitted from light emitting elements 110 positioned at a proximal end of reflector 602 surrounded by first opening 614. Furthermore, each of the corner facets may be positioned such that their normal centroidal axes pass through their corresponding corner. As shown in FIGS. 6C and 6D, corner facets may also be symmetrically positioned about central axis 208 in order to increase a uniformity of a light distribution directed on to a photosensitive curable surface of a work piece positioned distally of reflector 602. Incident light rays such as light rays 694 and 696 at the reflector corners are reflected and collimated along reflector edges towards distal corners of reflector 602. In this way, reflector 602 having corner facets decreases retro-reflection of light from the reflector corners, and increases an amount of light directed along the edges 662, 664, 666, and 668 towards distal reflector corners. Thus, a uniformity in the distribution of light at a photosensitive curable surface of a work piece positioned at a distal side of reflector 602 may be increased relative to a reflector having no corner facets.

Turning now to FIG. 7, it illustrates an example schematic 700 illustrating a method of measuring a uniformity of radiant output at a work piece surface 710. Photosensitive devices may be configured to detect an intensity of light at various detector locations 720 of work piece surface 710. In the example of schematic 700, nine detector locations 720 (e.g., nine point uniformity metric) are distributed in a grid pattern across a square work piece surface 710 for measuring radiant output at the work piece surface 710. As an example, the work piece surface 710 may be 100 mm by 100 mm, and the detector locations 720 may be 10 mm in diameter. Work piece surface 710 may be symmetrically positioned about central axis 208. A uniformity of the radiant output across work piece surface 710 may be quantified from equation (1):

$$U = \left(\frac{\mathrm{Max}(I) - \mathrm{Min}(I)}{\mathrm{Max}(I)}\right) \qquad \text{Equation (1)}$$

In Equation (1), I represents the intensity of radiant output measured at a specific location, Max(I) represents the maximum intensity of radiant output measured at the specific location, and Min(I) represents the minimum intensity of radiant output measured at the specific location. U is a measure of the uniformity of radiant output, where a lower value of U indicates a higher uniformity in the distribution of radiant output. U may be calculated at each detector location, or may be averaged across all detector locations to provide a metric indicative of the uniformity of the radiant output distribution.

In other examples, a higher or lower number of detector locations 720 may be used. A higher number of detector locations may provide a more reliable measure of radiant output uniformity at work piece surface, but may be more costly to implement. In the example of FIG. 7, a majority of detector locations 720 are positioned at corners and edges of the work piece surface 710. Configuring the detector locations 720 in this way may aid in measuring non-uniformities in the radiant output distribution at work piece surface 710 caused by retro-reflection of light at reflector corners and edges, as described above with reference to FIGS. 2A, 2B, 3, 4, 5A-5D, and 6A-6D. Furthermore, configuring the detector locations 720 in this way may aid in measuring increases in the uniformity of the radiant output distribution at work piece surface 710 caused by reflection and collimation of light at along edges towards distal reflector corners for reflectors having corner facets.

Turning now to FIG. 8, it illustrates schematics of radiant intensity distributions 800, 810, 820, and 830 (with corresponding radiant intensity scales 809, 819, 829, and 839, respectively) of radiant output from various lighting devices. Distributions 800 and 810 illustrate 160 mm square radiant output distributions from lighting devices having 65 mm long (e.g., dimension in the z-direction) square frustum reflectors with no corner facets to a work piece surface positioned at a distance 10 mm and 20 mm away, respectively, from the lighting device. As an example, distributions 800 and 810 may represent radiant output distributions from a square frustum reflector having no corner facets such as reflector 600. Central regions 808 and 818 exhibit the highest radiant output intensity levels of radiant intensity distributions 800 and 810, respectively. Region 808 exhibits approximately 0.9 W/cm$^2$-1.0 W/cm$^2$, while region 810 exhibits approximately 0.8 W/cm$^2$-0.89 W/cm$^2$. However retro-reflection at the reflector edges give rise to non-uniform regions 806 and 816 within central regions 808 and 818, respectively, that exhibit lower radiant output intensities of about 0.7 W/cm$^2$. Radiant output intensity of distributions 800 and 810 decreases gradually towards their respective perimeters: perimeter regions 807 and 817 exhibit lower radiant output intensities (approximately 0.6 W/cm$^2$) than central regions 808 and 818, respectively; and perimeter regions 804 and 814 exhibit lower radiant output intensities (approximately 0.35 W/cm$^2$) than perimeter regions 807 and 817, respectively. Furthermore, retro-reflection at reflector corners, in the absence of corner facets, gives rise to corner shadowing at regions 802 and 812, respectively, where radiant output intensities decrease to near 0.1 W/cm$^2$. The nine point uniformity metric for radiant output distributions 800 and 810 is 33%. Comparison of radiant output distributions 800 and 810 indicates that positioning the work piece a longer distance away from a lighting device enlarges and diffuses the regions of non-uniform radiant output. For example, corner shadowing at regions 812 occurs over larger corner regions as compared to regions 802; retro-reflection along the reflector edges gives rise to larger and more diffuse regions 816 relative to regions 806; and perimeter regions 817 and 814 are larger (thicker) but more diffuse than regions 807 and 804, respectively. However, increasing the distance of a work piece from a light source may also increase an amount of time needed for complete curing of the work piece.

Turning to distributions 820 and 830, they illustrate radiant output distributions directed on a work piece surface positioned at a distance 10 mm and 20 mm away, respectively, from the lighting device having a 65 mm long square frustum reflector having corner facets. The nine point uniformity metric for distributions 820 and 830 is 12%. Thus, employing a reflector with corner facets increases the uniformity of the radiant output distribution relative to a lighting device employing the same reflector but without corner facets. Examination of distributions 820 and 830 illustrate that central regions 828 and 838 (e.g., higher intensity regions) are larger as compared to central regions 808 and 818. Consequently, perimeter regions 824 and 827, and 834 and 837 are thinner and closer to the distribution perimeter as compared to perimeter regions 804 and 807, and 814 and 817, respectively. Further still, because of the presence of corner facets, retro-reflection along the reflector edges is reduced and non-uniformities in central regions 828 and 838 are not detected (compare regions 806 and 816 respectively for the case where no corner facets are employed). Further still, because of the presence of corner facets, retro-reflection of light at reflector corners causing corner shadowing is reduced as indicated by regions 822 and 832 being much smaller than regions 802 and 812. Furthermore, the radiant output intensity of regions 822 and 832 may be slightly higher (e.g., about 0.15-0.2 W/cm$^2$) as compared with the radiation output intensity of regions 802 and 812, respectively.

The reflector dimensions may also influence the uniformity of the radiant output distribution at the work piece surface. For example, lengthening a reflector (along the z-direction) may aid in reducing non-uniformities in the radiant output distribution. For example, a 125 mm reflector without corner facets (e.g., doubling the length of the reflector 600) may generate a radiant output distribution equivalent to distributions 820 and 830. However, as described above, increasing the distance of a work piece from a light source may also increase an amount of time needed for complete curing of the work piece. Thus, a reflector having no corner facets may be approximately double the length of a reflector having corner facets in order to generate an equivalently uniform radiant output distribution. Reflector dimensions may be influenced by the shape and size of the radiant output distribution. Irradiance intensity may be adjusted by the total power (e.g., number of light emitting elements, power supplied to light emitting elements, and the like) and the layout of the light emitting elements. The taper angle and the length of the reflector may depend on the distance to the target work piece surface, and the uniformity of the radiant output distribution. Incorporating corner facets into a lighting device reflector may allow for a shorter, smaller reflector that delivers a higher radiant output intensity to a work piece surface while maintaining the radiant output uniformity, as compared to a reflector having no corner facets. The tapered frustum reflector with corner facets may further be scaled to deliver equivalently uniform radiant output distributions over larger or smaller work piece surface areas by increasing or decreasing the reflector and facet dimensions and the number and/or power of the light emitting elements, respectively.

In this manner, a lighting device may comprise a light emitting element and a reflector, the reflector comprising: a first opening surrounding the light emitting element and a second opening; reflector side walls forming the first and second openings, the reflector side walls divergently extending from the first opening away from the light emitting element to the second opening; and corner facets, wherein each corner facet is positioned over a corresponding reflector corner formed by an adjacent pair of reflector side walls at the first opening. Additionally or alternately, a normal centroidal axis of each corner facet may pass through the corresponding reflector corner. Additionally or alternately, the first and second openings may comprise polygonal openings having a first number of sides corresponding to the first number of reflector side walls. Additionally or alternately, the reflector side walls may comprise planar surfaces. Additionally or alternately, the reflector side walls may comprise non-planar surfaces. Additionally or alternately, each of the corner facets may be mounted to at least one reflector side wall. Additionally or alternately, each of the corner facets may comprise planar surfaces. Additionally or alternately, each of the corner facets may comprise non-planar surfaces. Additionally or alternately, each of the corner facets may comprise polygonal corner facets, the polygonal corner facets each having a second number of vertices. Additionally or alternately, each of the corner facets may comprise triangular corner facets and the second number of vertices comprises three. Additionally or alternately, each of the corner facets may comprise rectangular corner facets and the second number of vertices comprises four.

In another embodiment, a lighting device may comprise an array of light emitting elements, a frustum reflector having a shape aspect, the frustum reflector comprising, first and second openings having an opening shape corresponding to the shape aspect, reflector side walls joined to form the first and second openings, a number of reflector side walls corresponding to the shape aspect, and corner facets positioned at corners formed by intersection of adjacent reflector side walls and the first opening, a number of corner facets corresponding to the shape aspect. Additionally or alternately, the shape aspect may comprise a rectangular shape, wherein the opening shape comprises a rectangle, the number of reflector side walls comprises four, and the number of corner facets comprises four. Additionally or alternately, the lighting device may comprise corner facets positioned at the corners, wherein normal centroidal axes of the corner facets pass through the corresponding corners. Additionally or alternately, the corner facets may comprise triangular facets. Additionally or alternately, the corner facets may comprise rectangular facets.

Turning now to FIG. 9, it illustrates a flow chart for a lighting method for employing a lighting device 10 having a reflector with corner facets. Method 900 may comprise executable instructions that are executed in part or in entirety by a lighting device controller such as controller 108 or by another controller external to the lighting device 10. Method 900 begins at 910 where light energy (e.g., radiant output 24) is supplied principally along a central axis 208 via a light emitting device to a work piece. Principally emitting radiant output 24 about the central axis 208 may comprise orienting the light emitting elements such that the radiant output 24 is emitted symmetrically about the central axis. Principally emitting radiant output 24 about the central axis may further comprise emitting radiant output with the highest intensity in the direction along the central axis. Method 900 continues at 920 where a tapered reflector, such as reflector 200, is positioned between the light emitting elements of the lighting device 10 and the work piece 26. As described above, tapered reflector 200 may comprise reflector side walls, each reflector side wall being coupled with and having common edges with two adjacent reflector side walls. The reflector side walls may form a first opening 214 at a proximal end 218 of the reflector 200 and surrounding the light emitting elements 110. Furthermore, the reflector side walls may divergently extend from the first opening 214 away from the light emitting elements 110 to form the second opening 212. In this way, the reflector 200 may be described as a tapered reflector, the reflector side walls tapering from the second opening 212 distal from the light emitting elements 110 to the first opening 214 proximal to the light emitting elements 110. The first opening 214, second opening 212, and the reactor side walls may be arranged symmetrically about central axis 208.

Method 900 continues at 930 where corner facets are positioned at corners of the tapered reflector. As described above, reflector 200 may comprise corners at a proximal end 218 formed by the intersection of pairs of adjacent side walls and the first opening 214. Corner facets may be positioned at or over a corresponding reflector corner so as to obstruct radiant output 24 from reaching each of the corresponding proximal reflector corners. Furthermore, each of the corner facets may be positioned to be non-coplanar with any of the reflector side walls and the first opening 214. In this way, the corner facets may aid in reducing retro-reflection of incident radiant output 24 at the reflector corners and may aid in increasing an amount of radiant output 24 being reflected along the reflector edges towards the distal corners. In one example, corner facets may be positioned at corresponding corner such a normal centroidal axis passes through the corresponding corner. As described above positioning the corner facets may include mounting or attaching at least one of the vertices of each of the corner facets to an adjacent reflector side wall. Additionally or alternately, positioning the corner facets may include mounting or attaching at least one of the vertices of each of the corner facets at a space 591 in between the light emitting elements 110 and the reflector side walls.

Method 900 continues at 940 where radiant output emitted through the first opening and incident at the reflector side walls is collimated about the central axis 208 through the second reflector opening toward the work piece. This portion of the radiant output may largely give rise to the central regions (e.g., 828, 838) of the radiant output distribution. Method 900 continues at 950 where radiant output emitted through the first opening and incident at corner facets along corner edges of the tapered reflector is collimated and/or reflected towards distal corners of the tapered reflector. In this way, corner facets may reduce retro-reflection at reflector corners and increase a uniformity of a radiant output distribution at a workpiece surface distal to the lighting device.

At 960, method 900 determines if a uniformity measurement is less than a threshold uniformity. In one example, a uniformity measurement may comprise a uniformity metric, U, as described above with reference to FIG. 7, and the threshold uniformity may be $U_{TH}$. If the uniformity measurement is less than a threshold uniformity (e.g., $U>U_{TH}$), method 900 continues at 964 where the lighting device may be repositioned (e.g., positioned more symmetrically about central axis 208), the reflector may be adjusted (e.g., positioned more symmetrically about central axis 208, or a distance from the work piece may be increased or decreased, or a replacement reflector with different dimensions or shape aspect may be used), or the corner facets may be adjusted (e.g., positioned more symmetrically about central axis 208, or adjusted so that a normal centroidal axis passes more closely through the corresponding corner, or a replacement corner facet with different dimensions or shape aspect may be used). After 964, method 900 ends.

In this manner, a lighting method may comprise: emitting light from a light emitting element about a central axis on to a work piece; positioning a reflector between the light emitting element and the work piece, wherein light emitted through a first opening and incident at reflector side walls is collimated through a second opening of the reflector toward the work piece about the central axis; and positioning corner facets at corresponding corners of the reflector, wherein light incident at the corner facets is collimated towards the work piece about the central axis, wherein the reflector side walls form the first opening proximal to the light emitting element and diverge away from the central axis towards the work piece to form the second opening, and the corresponding corners of the reflector are formed by an intersection of an adjacent pair of reflector side walls and the first opening. Additionally or alternately, positioning the corner facets at the corresponding corners of the reflector may comprise positioning the corner facets, wherein a normal centroidal axis of each of the corner facets passes through the corresponding corner. Additionally or alternately, the method may comprise positioning the corner facets at the corresponding corners, wherein light incident at the corner facets is collimated along the intersection of the adjacent pair of reflector side walls of the corresponding corner toward the work piece. Additionally or alternately, the method may comprise positioning the corner facets at the corresponding corners, wherein light incident at the corner facets is reflected towards distal corners of the tapered reflector formed by the intersection of the adjacent pair of reflector side walls of the corresponding corner and the second opening.

In this manner, the technical effect of uniformly irradiating a target photosensitive work piece while mitigating under-curing and over-curing may be achieved, while reducing a size of the coupling optics and reducing a distance between the light emitting elements and the work piece, thereby decreasing cure times and lowering manufacturing costs.

Note that the example control and estimation routines included herein can be used with various lighting devices or lighting system configurations. The control methods and routines disclosed herein may be stored as executable instructions in non-transitory memory and may be carried out by the control system including the controller in combination with the various sensors, actuators, and other lighting system hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the lighting system, where the described actions are carried out by executing the instructions in a system including the various lighting hardware components in combination with the controller.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A lighting device, comprising a light emitting element and a reflector, the reflector comprising:

a first opening surrounding the light emitting element and a second opening;

reflector side walls forming the first and second openings, the reflector side walls divergently extending from the first opening away from the light emitting element to the second opening; and corner facets contacting an adjacent pair of reflector side walls at the first opening, wherein each corner facet is positioned interior relative to a corresponding reflector corner formed by the adjacent pair of reflector side walls at the first opening.

2. The lighting device of claim 1, wherein a normal centroidal axis of each corner facet passes through the corresponding reflector corner.

3. The lighting device of claim 2, wherein the first and second openings comprise polygonal openings having a first number of sides corresponding to a first number of reflector side walls.

4. The lighting device of claim 3, wherein the reflector side walls comprise planar surfaces.

5. The lighting device of claim 3, wherein the reflector side walls comprise non-planar surfaces.

6. The lighting device of claim 4, wherein each of the corner facets is mounted to at least one reflector side wall, and the light emitting element and uppermost edges of the corner facets and uppermost edges of the reflector side walls are approximately in plane.

7. The lighting device of claim 6, wherein each of the corner facets comprises planar surfaces.

8. The lighting device of claim 7, wherein each of the corner facets comprises polygonal corner facets, the polygonal corner facets each having a second number of vertices.

9. The lighting device of claim 6, wherein each of the corner facets comprises non-planar surfaces.

10. The lighting device of claim 8, wherein each of the corner facets comprises triangular corner facets and the second number of vertices comprises three.

11. The lighting device of claim 8, wherein each of the corner facets comprises rectangular corner facets and the second number of vertices comprises four.

12. A lighting method, comprising:

emitting light from a light emitting element about a central axis on to a work piece;

positioning a reflector between the light emitting element and the work piece, wherein light emitted through a first opening and incident at reflector side walls is collimated through a second opening of the reflector toward the work piece about the central axis; and positioning corner facets interior relative to corresponding corners of the reflector and in contact with an adjacent pair of reflector side walls at the first opening, wherein light incident at the corner facets is collimated towards the work piece about the central axis, wherein the reflector side walls form the first opening proximal to the light emitting element and diverge away from the central axis towards the work piece to form the second opening, and the corresponding corners of the reflector are formed by an intersection of the adjacent pair of reflector side walls and the first opening.

13. The method of claim 12, wherein positioning the corner facets interior relative to the corresponding corners of the reflector comprises positioning the corner facets, wherein a normal centroidal axis of each of the corner facets passes through the corresponding corner.

14. The method of claim 13, further comprising positioning the corner facets interior relative to the corresponding corners, wherein light incident at the corner facets is collimated along the intersection of the adjacent pair of reflector side walls of the corresponding corner toward the work piece.

15. The method of claim 14, further comprising positioning the corner facets interior relative to the corresponding corners, wherein light incident at the corner facets is reflected towards distal corners of the tapered reflector formed by the intersection of the adjacent pair of reflector side walls of the corresponding corner and the second opening.

16. A lighting device comprising:

an array of light emitting elements, a frustum reflector having a shape aspect, the frustum reflector comprising, first and second openings having an opening shape corresponding to the shape aspect, reflector side walls joined to form the first and second openings, a number of reflector side walls corresponding to the shape aspect, and corner facets positioned interior relative to corners formed by an intersection of adjacent reflector side walls and the first opening and positioned in contact with the adjacent reflector side walls at the first opening, a number of corner facets corresponding to the shape aspect.

17. The lighting device of claim 16, wherein the shape aspect comprises a rectangular shape, wherein the opening shape comprises a rectangle, the number of reflector side walls comprises four, and the number of corner facets comprises four.

18. The lighting device of claim 17, further comprising corner facets positioned at the corners, wherein normal centroidal axes of the corner facets pass through the corresponding corners.

19. The lighting device of claim 18, wherein the corner facets comprise triangular facets.

20. The lighting device of claim 18, wherein the corner facets comprise rectangular facets.

* * * * *